US005328291A

United States Patent [19]

Wisniewski

[11] Patent Number: 5,328,291

[45] Date of Patent: Jul. 12, 1994

[54] LOCKING MANHOLE INSERT

[76] Inventor: Robert S. Wisniewski, 3167 Bristol, N.W., Walker, Mich. 49504

[21] Appl. No.: 949,996

[22] Filed: Sep. 24, 1992

[51] Int. Cl.[5] ..... E02D 29/12

[52] U.S. Cl. ..... 404/2; 404/4; 404/24; 404/25; 52/20; 52/21

[58] Field of Search ..... 404/25, 26; 70/25, 33, 70/167, 168, 169; 49/35, 465; 52/20, 19, 21; 292/109, 110, 205, 104, 148, 7

[56] References Cited

U.S. PATENT DOCUMENTS

| | | | |
|---|---|---|---|
| 315,836 | 4/1885 | Raynald | 454/48 |
| 525,256 | 8/1894 | Buckley | 292/205 |
| 682,530 | 9/1901 | Clark | 292/104 |
| 911,256 | 2/1909 | McWane | 220/251 |
| 1,001,041 | 8/1911 | Jones | 404/25 |
| 1,152,618 | 9/1915 | Farris | 404/25 |
| 1,204,464 | 11/1916 | Lofton | 404/25 |
| 1,458,391 | 6/1923 | Burton | 404/25 |
| 2,363,567 | 11/1944 | Blakeman | 292/6 |
| 3,921,494 | 11/1975 | Coe | 85/3 |
| 4,461,597 | 7/1984 | Laurin | 404/25 |
| 4,512,492 | 4/1985 | Graybeal | 404/25 |
| 4,523,407 | 6/1985 | Miller | 49/465 |
| 4,723,866 | 2/1988 | McCauley | 404/25 |
| 4,763,449 | 8/1988 | Vigneron et al. | 52/20 |
| 4,902,165 | 2/1990 | Embree | 404/25 |
| 4,964,755 | 10/1990 | Lewis et al. | 404/25 |
| 5,056,955 | 10/1991 | Spiess et al. | 404/25 |
| 5,082,392 | 1/1992 | Marchese et al. | 404/25 |

FOREIGN PATENT DOCUMENTS

| | | | |
|---|---|---|---|
| 41210 | 4/1908 | Switzerland | 404/25 |

*Primary Examiner*—Ramon S. Britts
*Assistant Examiner*—Pamela O'Connor
*Attorney, Agent, or Firm*—Warner, Norcross & Judd

[57] ABSTRACT

A locking manhole insert to be placed under a conventional manhole cover to prevent unauthorized access to the manhole. The insert includes a plate-shaped disc with a plurality of locking radial arms mounted to its undersurface. The locking radial arms are securable in the extended position using a conventional padlock. The insert further includes apparatus for suspending equipment, such as pollution monitoring units, within the manhole opening.

11 Claims, 1 Drawing Sheet

LOCKING MANHOLE INSERT

BACKGROUND OF THE INVENTION

The present invention relates to a locking manhole insert and more specifically to a locking manhole insert designed to be placed under an existing manhole cover for the security of any equipment which might be placed thereunder.

To monitor for unauthorized effluent pollutants, environmental monitoring equipment often is installed through manholes into sanitary sewer and stormsewer pipes. The monitoring equipment is typically left in a single location for an extended period of time (e.g. one week) and then removed for data extraction. Such equipment is generally well known in the environmental testing art.

Unfortunately such equipment sometimes is tampered with since it is left unattended by authorized personnel for many days. Tampering may be for the purpose of intentionally affecting (e.g. improving) the acquired data. Tampering may also occur by curious people who want to see what was placed in the hole. Obviously, any tampering is undesirable.

Applicant is not aware of any commercially available device for securing the testing equipment within the manhole. However, Applicant is aware that locking manhole covers are shown in the patent literature.

One such locking manhole cover is disclosed in U.S. Pat. No. 5,082,392, issued Jan. 21, 1992, to Marchese. The Marchese cover has radial locking arms mounted on the underside of an otherwise generally conventional manhole cover. These radial arms are retracted and extended by rotating an actuating disc that is accessible through a vent hole in the cover. A key is provided that extends through the vent hole and is used to rotate the disc.

A second locking manhole cover is disclosed in U.S. Pat. No. 4,964,755, issued on Oct. 23, 1990, to Lewis et al. The Lewis cover also has radial locking arms attached to an actuating disc that is mounted on the underside of an otherwise generally conventional manhole cover. The actuating disc is spring-biased upwardly toward the cover and has a series of locking pins that engage holes in the cover. The actuating disc is accessed through a vent in the cover using a special key. To turn the actuating disc, one must use the special key to force the plate downward, so as to disengage the locking pins from the cover, and rotate the disc.

Marchese and Lewis suffer from a series of shortcomings. First, both inventions are designed to be used in place of an existing manhole cover. Therefore, they must meet the structural requirements of a conventional manhole cover. This makes them expensive to fabricate and, as a result of their weight, burdensome to use. Second, both locking manhole covers require a special key to actuate the locking mechanism. This means that an individual who gains access to a single key can unlock and remove all covers. In this sense, the covers are not truly secure. Third, if the locking mechanism malfunctions, or the key is misplaced, it may be necessary to damage or destroy the locking cover in order to remove it from the manhole frame.

SUMMARY OF THE INVENTION

The aforementioned problems of manhole security are overcome by the present invention wherein a locking manhole insert is provided which may be installed underneath a conventional manhole cover to restrict access to any equipment which might be temporarily located within the manhole.

The manhole insert includes a plate-shaped body that fits within a conventional manhole frame. A series of locking radial arms are attached to an actuating disc mounted on the underside of the insert body. The body includes a peripheral lip and a floor that supports the insert within the manhole frame opening by resting upon the manhole frame support flange. The floor of the plate-shaped disc is recessed below the lip, defining a void. Portions of the locking and/or actuating mechanism are located within the void on the floor of the insert body and under the conventional manhole cover.

The rotating disc includes an actuating handle extending through the insert and accessible from the top of the manhole insert. The radial arms are retracted and extended by operating the handle. A fixed ear is secured to the insert floor. The handle is aligned with the fixed ear when the radial arms are in the extended position, enabling the handle to be padlocked to the fixed ear and prevent the radial arms from being retracted.

In a preferred embodiment, chains are mounted to the undersurface of the manhole insert. These chains can be used to suspend equipment, such as a pollution monitoring sampling unit, within the manhole opening. Once installed and locked, the manhole insert prevents access to the manhole opening and any equipment suspended therein.

The present insert is relatively simple and inexpensive to fabricate. The insert need not meet all the structural requirements of a conventional manhole cover, which is reinstalled over the insert.

A structure that permits the use of conventional padlocks enables a different lock for each manhole insert. Use of a conventional padlock is also less expensive than incorporating a key-lock mechanism into each manhole insert. Further, if the padlock key is lost or misplaced, the padlock can be cut rather than damaging or destroying the manhole insert.

These and other objects, advantages, and features of the present invention will be more fully understood and appreciated by reference to the detailed description of the preferred embodiment and the drawings.

DETAILED DESCRIPTION OF THE PREFERRED EMBODIMENT

Figure 2:
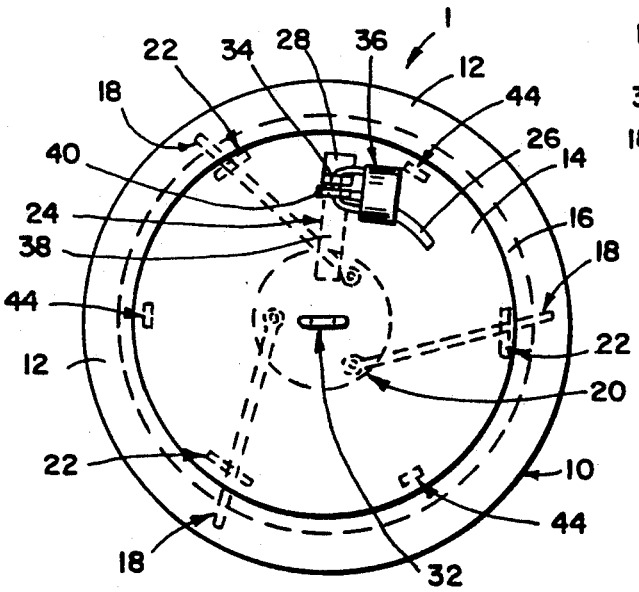
FIG. 2 is a top view of a preferred embodiment of the present invention.
Figure 1:
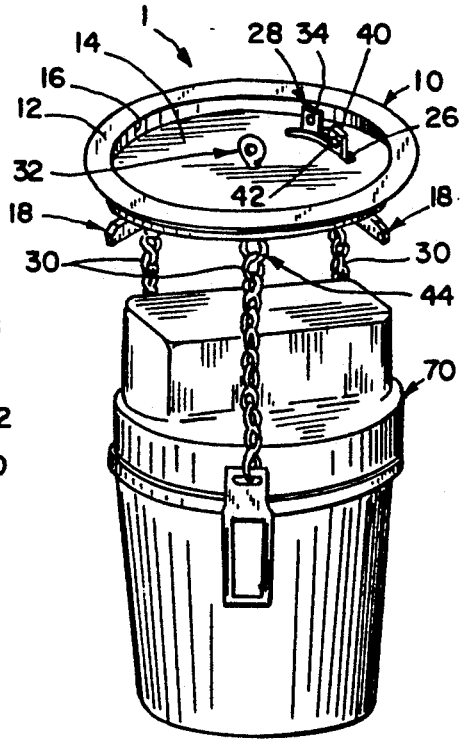
FIG. 1 is a perspective view of a preferred embodiment of the present invention suspending a pollution monitoring unit.

A locking manhole insert 1 constructed in accordance with the preferred embodiment of the present invention is generally illustrated in FIGS. 1 and 2, and includes a plate-shaped body 10 having a plurality of radial locking arms 18 attached to a rotating disc 20 concentrically mounted on the undersurface of the insert. When installed, the body fits underneath a conventional manhole cover to prevent unauthorized access.

The body is easily installed and locked, and also unlocked and removed.

The plate-shaped body 10 includes a circular, planar floor 14, a circumferential wall 16, and a peripheral lip 12. The floor 14 is disc-shaped and has a diameter slightly smaller than the internal diameter of the support flange 62 in the manhole frame 60. The circumferential wall 16 extends axially upward from the outer edge of the floor 14. The lip 12 extends radially outward from the top of the circumferential wall 16 and has an external diameter substantially identical to the diameter of a conventional manhole cover 64. The floor defines an arcuate slot to receive the actuating handle as will be described. A fixed ear or lug 28 is secured, for example, by welding to the floor 14 adjacent one end of the slot 26. The ear defines a hole 34 for receiving a padlock 36. A fixed ring or eye 32 is fixedly secured to the top surface of the floor 14, for example, by welding (see FIG. 2). This ring 32 is used in installing and removing the plate-shaped insert 10. The circumferential wall 16 creates a space between the lip 12 and floor 14, so that the manhole cover 64 may be seated upon the lip 12 without interference from any elements that may extend above or lie upon the floor 14.

A pivoting actuating disc 20 with a diameter substantially smaller than the floor 14 is concentrically mounted to the underside of the plate-shaped body 10. One end of each of the locking radial arms 18 is pivotally attached to the rotating disc 20 in a radially symmetric manner. A fixed guide 22 is radially aligned with each locking radial arm 18 and is attached to the underside of the plate-shaped body 10. Each locking radial arm 18 slidably passes through its corresponding fixed guide 22. The fixed guide 22 provides a fixed point through which each locking radial arm 18 must pass when being retracted or extended.

Figure 3:
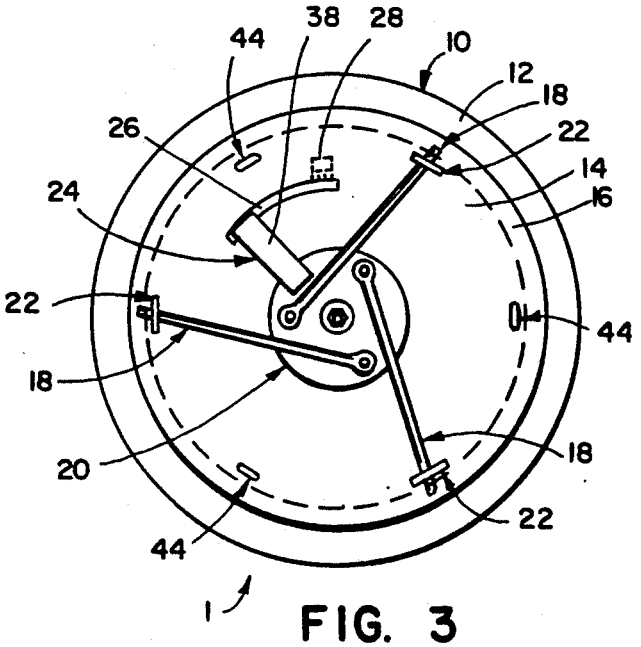
FIG. 3 is a bottom view of a preferred embodiment of the present invention.

An L-shaped actuating handle 24 is fixedly attached, for example, by welding to the rotating disc 20 (see FIG. 1). The long leg 38 of the handle 24 extends radially from the rotating disc 20. The short leg 40 of the handle 24 extends upward through the arc-shaped slot 26 in the floor 14 of the plate-shaped body 10 (see FIG. 3). The short leg 40 defines a hole 42 for receiving a padlock 36. The holes 34 and 42 are aligned to receive the padlock when the insert 1 is locked in position. The slot 26 defines the range of motion for the handle 24. The rotating disc 20 is rotated by moving the handle 24 back and forth along the arc-shaped slot 26. Rotating this disc 20 in turn retracts or extends the radial locking arms 18. The handle 24 abuts the fixed ear 28 when the radial arms 18 are in the extended position. When the handle 24 is secured to the fixed ear 28 the locking radial arms 18 can not be retracted.

Figure 4:
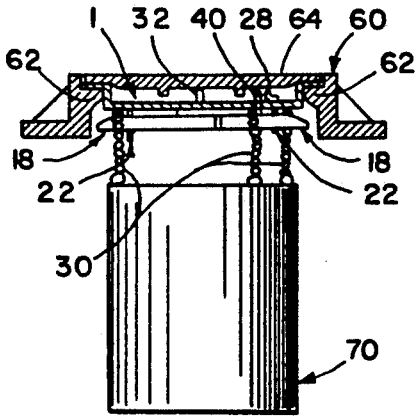
FIG. 4 is a sectional view of the present invention installed in a conventional manhole frame and suspending a pollution monitoring unit.

As shown in FIG. 1, a plurality of fixed rings 44 are attached to the undersurface of the plate-shaped body 10 in a radially symmetric manner. A chain 30 is attached to each of these fixed rings 44 for use in suspending equipment, such as environmental monitors, below the plate-shaped body 10 (see FIGS. 3 and 4).

When a sampling device is to be placed in a manhole, the conventional manhole cover is removed, and the sampling unit 70 is suspended from the insert 1 on the chains 30. The unit 70 and insert with the locking arms 18 retracted are then lowered into the manhole 60, optionally using the suspension ring 32. Upon complete installation, the peripheral lip 12 sits upon the support flange 62 of the manhole frame 60. The floor 14 and circumferential wall 16 extend below the plane of the lip, and the sampling unit 70 is suspended below. To secure the plate-shaped body 10, the actuating handle is moved to the end of slot 26 adjacent the locking ear 28 to extend the locking radial arms 18. A padlock 36 is installed through the lug 28 and handle 24 to lock the arms in the extended position. Finally, the conventional manhole cover 64 is reinstalled on top of the plate-shaped body 10. As discussed above, the floor 14 is sufficiently recessed below the lip 12 to allow a manhole cover 64 to be seated upon the lip 12 above the padlock, actuating handle 24, and fixed ring 32. The process is reversed to remove the insert and sampling unit from the manhole.

The above description is that of a preferred embodiment of the invention. Various changes and alterations can be made without departing from the spirit and broader aspects of the invention as set forth in the appended claims, which are to be interpreted in accordance with the principles of patent law, including the doctrine of equivalents.

The embodiments of the invention in which an exclusive property or privilege is claimed are defined as follows:

1. A locking manhole insert to be installed within a manhole opening and under a manhole cover, said insert comprising:

a circular body including a peripheral lip adapted to rest in the manhole opening, said body being substantially unapertured with the exception of a locking handle slot, said lip defining a plane, said body having an upper side and an underside, said body including a circumferential wall and a floor, said floor being disc-shaped and having a diameter smaller than the diameter of the manhole cover, said circumferential wall extending axially upward from said floor, said lip extending radially outward from the top edge of said circumferential wall and having an exterior diameter substantially identical to a diameter of the manhole cover;

a locking mechanism on said underside of said body for selectively locking said body within the manhole opening, said locking mechanism including an actuating handle extending through said lot to be accessible from said upper side of said body, said handle being movable between a locked position and an unlocked position;

securing means for securing said actuating handle in the locked position; and suspension means secured to said underside of said body for suspending apparatus from said body, said body, said locking mechanism, and said securing means located below said plane defined by said lip, whereby said insert does not interfere with the installation of the manhole cover in the manhole opening over said insert.

2. A locking manhole insert as defined in claim 1 wherein said locking mechanism includes a rotating member, said rotating member being mounted to said underside of said body, said locking mechanism further including a plurality of radial locking arms and corresponding fixed guides, said radial locking arms being pivotally attached to said rotating member, said corresponding fixed guides being radially aligned with said radial locking arms and mounted to said underside of said body, said radial locking arms slidably interfitting with said corresponding fixed guides.

3. A locking manhole insert as defined in claim 2 wherein said slot is arc-shaped and concentrically aligned with said rotating member.

4. A locking manhole insert as defined in claim 3 wherein said actuating handle is further defined as an L-shaped handle having a long leg and a short leg, said long leg being radially attached to said rotating member, said short leg extending up through said slot in said body.

5. A locking manhole insert as defined in claim 4 wherein said securing means includes a fixed ear mounted to said upper side of said body, said fixed ear being tangentially aligned with said slot, whereby said L-shaped handle is securable to said fixed ear when said locking radial arms are in an extended position.

6. A locking manhole insert to be installed within a manhole opening and under a manhole cover, said insert comprising:

a generally circular body having a radially extending peripheral lip defining a plane, said body having an upper side and a lower side, said body including a circumferential wall and a floor, said floor being disc-shaped and having a diameter smaller than a diameter of the manhole cover, said circumferential wall extending axially upward from said floor, said lip extending radially outward from the top edge of said circumferential wall and having an exterior diameter substantially identical to the diameter of the manhole cover; and locking means for selectively locking said insert within the manhole, said locking means being mounted on said lower side of said body, said locking means including an actuating means extending through said body to be accessible from said upper side of said body, said locking means further including securing means for securing said actuating means in a locked position, said securing means being accessible from said upper side of said body, said body and said locking means located below said plane defined by said lip.

7. A locking manhole insert as defined in claim 6 wherein said locking means further including:

a rotating disc concentrically mounted to said lower side of said body;

a plurality of radial locking arms pivotally attached to said rotating disc;

a plurality of fixed guides mounted to said lower side of said body, one of said fixed guides being radially aligned with each of said radial locking arms, said radial locking arms slidably interfitting with said fixed guides.

8. A locking manhole insert as defined in claim 7 wherein said actuating means includes an actuating handle, said actuating handle extending radially out from said rotating disc and up through an arc-shaped slot defined in said floor of said body.

9. A locking manhole insert as defined in claim 8 wherein said securing means includes a fixed ear mounted to said upper side of said body, said fixed ear aligned with said actuating handle when said radial locking arms are extended, whereby said actuating handle is securable to said fixed ear to prevent retraction of said radial locking arms.

10. A locking manhole insert as define din claim 6 wherein a plurality of radially symmetric fixed rings are mounted to the undersurface of said plate-shaped insert, whereby equipment may be suspended from said lower side of said body.

11. A locking manhole insert to be installed within a manhole opening and under a manhole cover, said insert comprising:

a plate-shaped insert having a circular planar floor, a circumferential wall, and a lip defining a plane, said floor having an upper side and an underside, said circumferential wall extending axially upward from said floor, said lip extending radially outward from the top edge of said circumferential wall, said floor of said plate-shaped insert defining an arcuate slot;

an actuating disc pivotally mounted to said underside of said floor of said insert;

a plurality of radial locking arms each pivotally attached to said actuating disc, whereby said arms can be extended and retracted by rotating said disc;

an actuating handle fixedly secured to said actuating discs and extending up through said arc-shaped slot in said floor of said insert for movement within said slot, said actuating handle being accessible from the upper surface of said plate-shaped insert; and a locking ear fixedly mounted on the upper side of said floor, each of said handle and locking ear defining apertures for receiving a locking mechanism when said arms are in the extended position, whereby said actuating handle is securable to said locking ear to prevent said locking radial arms from being retracted; said insert floor, said actuating disk, said locking arms, said actuating handle, and said locking ear being located below said plane defined by said lip.

* * * * *

UNITED STATES PATENT AND TRADEMARK OFFICE

CERTIFICATE OF CORRECTION

PATENT NO. : 5,328,291

DATED : July 12, 1994

INVENTOR(S) : Robert S. Wisniewski

It is certified that error appears in the above-indentified patent and that said Letters Patent is hereby corrected as shown below:

Column 4, Claim 1, Line 44:
"lot" should be --slot--

Column 6, Claim 10, Line 15:
"define din" should be --define--.

Signed and Sealed this

Twenty-fourth Day of January, 1995

*Attest:*

*Attesting Officer*

Bruce Lehman

BRUCE LEHMAN

*Commissioner of Patents and Trademarks*